US006942042B2

(12) United States Patent
Lee

(10) Patent No.: US 6,942,042 B2
(45) Date of Patent: Sep. 13, 2005

(54) PNEUMATIC MOTOR-CONTROLLED VALVE OF SCREWDRIVER

(75) Inventor: Yun-Chung Lee, Taipei Hsien (TW)

(73) Assignee: De Poan Pneamatic Corp., Taipei Hsien (TW)

( * ) Notice: Subject to any disclaimer, the term of this patent is extended or adjusted under 35 U.S.C. 154(b) by 54 days.

(21) Appl. No.: 10/705,542

(22) Filed: Nov. 12, 2003

(65) Prior Publication Data

US 2005/0098334 A1 May 12, 2005

(51) Int. Cl.[7] ..... B25B 21/00

(52) U.S. Cl. ..... 173/11; 173/13; 173/93.5; 81/57.44; 81/434; 227/136

(58) Field of Search ..... 173/11, 13, 4, 93, 173/93.5; 81/434, 433, 469, 57.44, 57.37; 227/136, 130

(56) References Cited

U.S. PATENT DOCUMENTS 2,818,893 A * 1/1958 Shaff ..... 81/430
5,730,035 A * 3/1998 Ohmori et al. ..... 81/57.44
5,862,724 A * 1/1999 Arata et al. ..... 81/434
6,026,713 A * 2/2000 Ohmori et al. ..... 81/57.44
6,061,901 A * 5/2000 Tanaka ..... 29/798
6,247,387 B1 * 6/2001 Ketteringham ..... 81/467
6,672,404 B2 * 1/2004 Kamo et al. ..... 173/11

* cited by examiner

*Primary Examiner*—Scott A. Smith

(57) ABSTRACT

A pneumatic motor-controlled valve of a screwdriver is installed between an air guide hole of a pneumatic motor and a main air valve gate in the screwdriver. A valve hole is formed on a guide seat and is communicated to an air guide hole of the motor. A plug is formed on an outer wall of a cylinder; and the cylinder is movably mounted within the guide seat. A lower spring resists against the cylinder. At least one ventilating hole is formed on a wall of the cylinder for communicating the valve hole to one of the upper valve opening and the lower valve opening of the main air valve gate. The plug drives the cylinder to actuate with the descending and rising of the piston valve so as to open or close the valve hole of the guide seat, thereby, the rotation of the motor is controlled.

3 Claims, 7 Drawing Sheets

PNEUMATIC MOTOR-CONTROLLED VALVE OF SCREWDRIVER

FIELD OF THE INVENTION

The present invention relates to screwdrivers, and particularly to a pneumatic motor-controlled valve of a screwdriver, wherein a valve hole and a plug are installed to a movable cylinder and a guide seat for controlling the opening and closing of the pneumatic motor.

BACKGROUND OF THE INVENTION

In one prior art screwdriver, a body of the screwdriver is installed with a cylinder, a piston rod, a pneumatic motor, etc. The piston rod is movably installed to the cylinder. The piston rod has a plug for opening or closing the motor air inlet valve. Thereby, high pressure air in the cylinder can push the pneumatic piston rod to linearly reciprocate and the high pressure air can drive the pneumatic motor to rotate and thus to drive the moving piston rod to rotate. Meanwhile, the plug on the piston rod can open or close the motor air inlet valve so as to control the motor to rotate or stop. Thereby, the piston rod can rotate and displace linearly as desired for locking a screw nail.

However, in above mentioned prior art, the plug for controlling the rotation of the motor is arranged on the piston rod which is rotatable and linearly movable. When the plug moves to motor air inlet valve for closing the valve opening, the plug of the piston rod still rotates, as a result, the air stop washer of the plug will wear easily so as to reduce the lifetime of the plug. Thereby, the prior art design has a short lifetime. These prior arts still exist in other prior art and can not be over-come effectively.

SUMMARY OF THE INVENTION

Accordingly, the primary object of the present invention is to provide a pneumatic motor-controlled valve of a screwdriver, wherein a plug is mounted to an outer wall of a movable cylinder so that the plug has only the effect of linearly movement (no rotation power) for closing the valve hole of inputting air to motor. Thereby, the lifetime of the plug is increased.

Another object of the present invention is to provide a pneumatic motor-controlled valve of a screwdriver, wherein a guide seat is installed in the head. At least one valve hole is formed on the wall of the guide seat so that the valve hole is communicated to the air guide hole of the pneumatic motor in the screwdriver, and the cylinder is linearly moved in the guide seat so that the plug serves to open and close the valve hole of the guide seat so as to control the rotation and stopping of the pneumatic motor.

To achieve above objects, the present invention provides a pneumatic motor-controlled valve of a screwdriver is installed between an air guide hole of a pneumatic motor and a main air valve gate in the screwdriver. A valve hole is formed on a guide seat and is communicated to an air guide hole of the motor. A plug is formed on an outer wall of a cylinder; and the cylinder is movably mounted within the guide seat. A lower spring resists against the cylinder. At least one ventilating hole is formed on a wall of the cylinder for communicating the valve hole to one of the upper valve opening and the lower valve opening of the main air valve gate. The plug drives the cylinder to actuate with the descending and rising of the piston valve so as to open or close the valve hole of the guide seat, thereby, the rotation of the motor is controlled.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
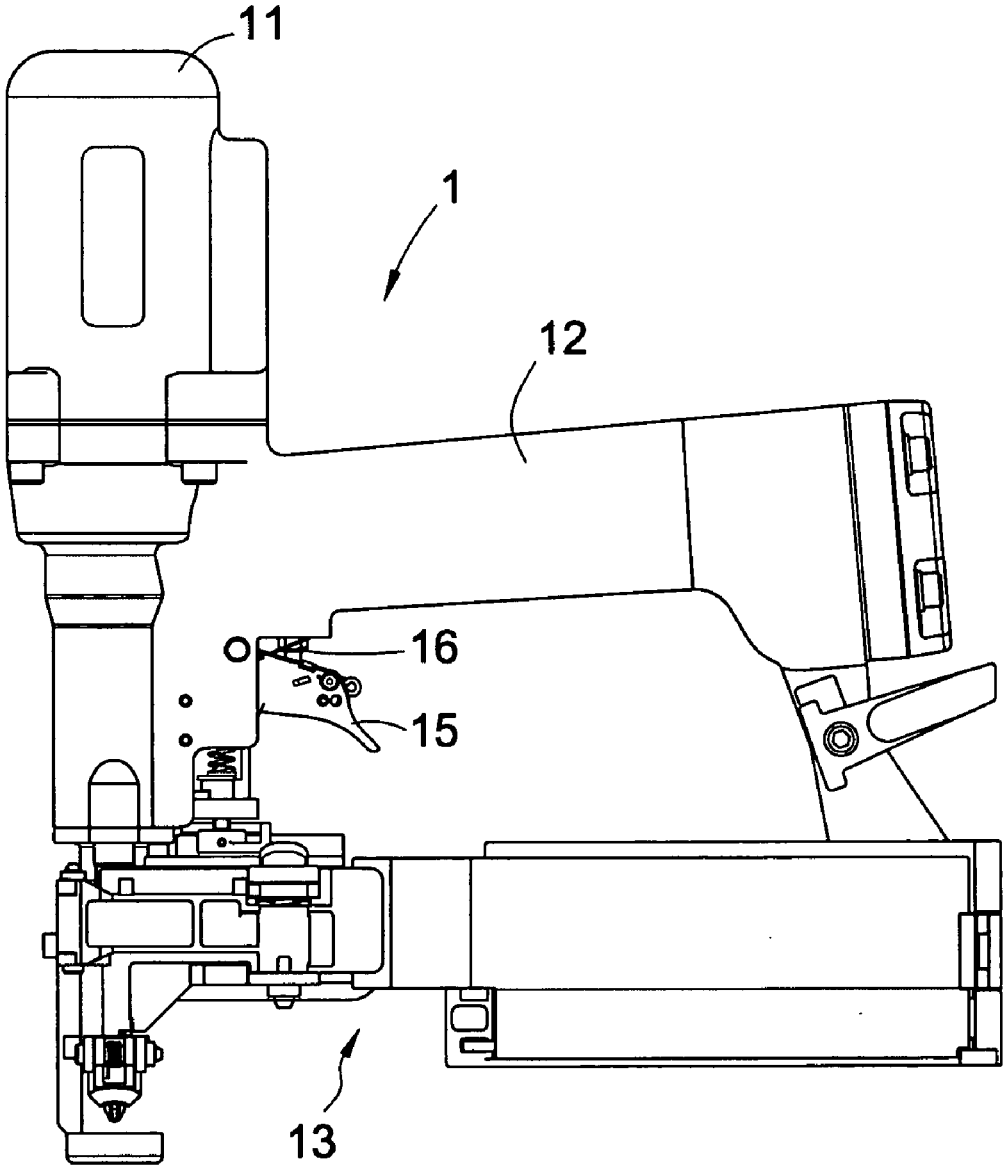
FIG. 1 is a perspective view of the screwdriver of the present invention.

With reference to FIG. 1, the perspective view of the pneumatic screwdriver of the present invention is illustrated. The screwdriver mainly includes a head 11 and a handle 12 which are formed as a screwdriver body 1. A lower end of the screwdriver body 1 is installed with a screw nail driver 13 for driving screw nails so as to drive the screw nails to a nail beating position. A bottom of the screwdriver body is installed with a trigger 15. Thereby, the user can trigger the trigger 15 to open a trigger valve 16 for driving the screw nail in the screwdriver body to a work piece.

Figure 2:
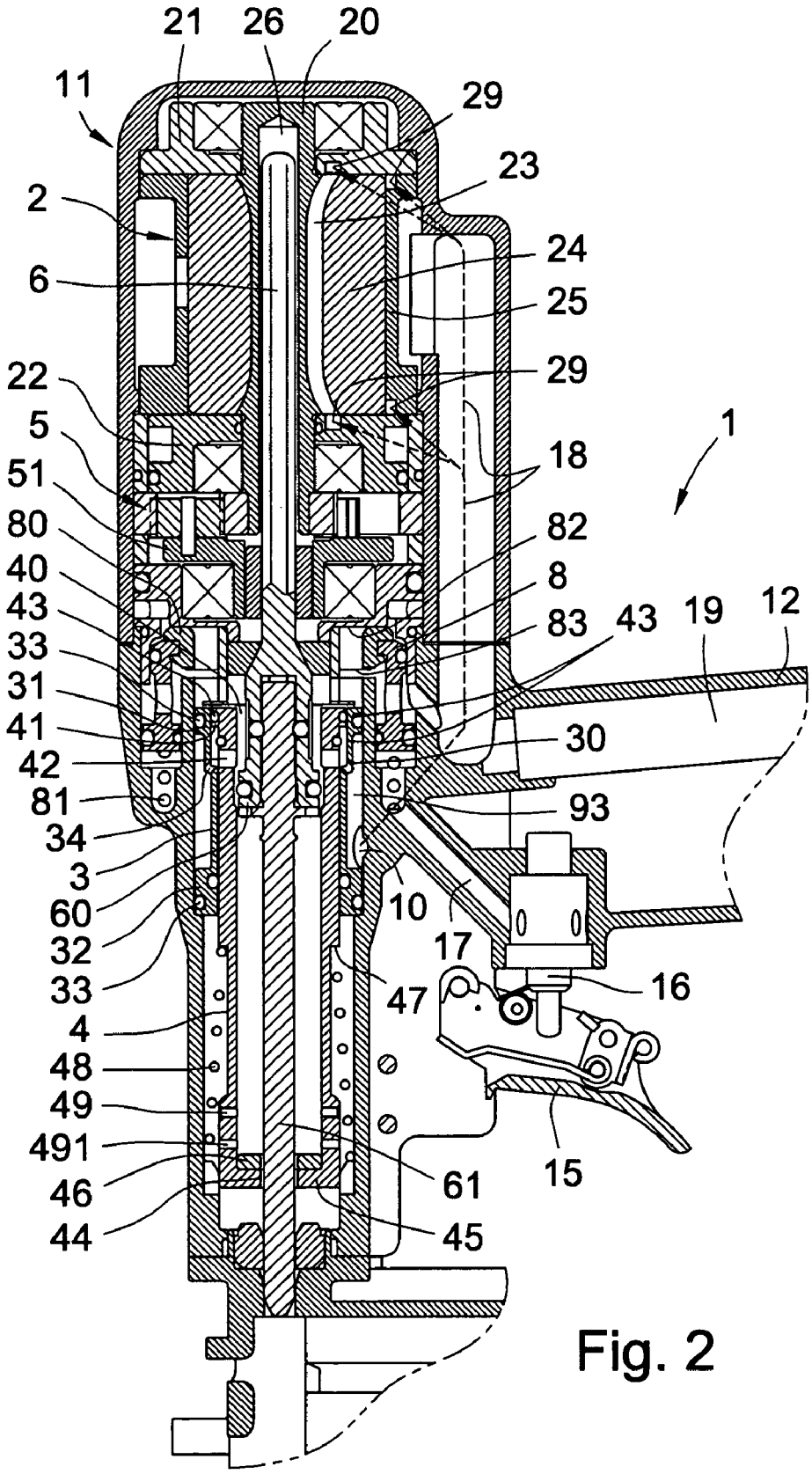
FIG. 2 is a schematic view of the head of the screwdriver of the present invention.

With reference to FIG. 2, the interior and the driving structure of the pneumatic screwdriver of the present invention are illustrated. The structure comprises a pneumatic motor 2 which is driven by high pressure air, a planet gear set 5 driven by the motor spindle 20; a power output disk 51 driven by the planet gear set 5 and a piston rod 6 driven by the output disk 51 and synchronously acting with the high pressure air so as to rotate and displace in a cylinder 4.

A pneumatic motor 2 has a spindle 20 at a central axis of the motor so as to install the pneumatic motor 2 between a bearing top seat 21 and a bearing bottom seat 22. An air inlet passes through the bearing top seat 21, bearing bottom seat 22 and the eccentric housing 25 so as to guide high pressure air to drive the motor 2 to rotate. A plurality of radiating blade grooves 23 are formed in the pneumatic motor 2 for receiving a plurality of blades 24. The blade grooves 23 are communicated to the air inlet 29. The number of the blades 24 is equal to that of the blade grooves 23. The blades are driven in an eccentric housing 25 by high-pressure air for driving the spindle 20. The spindle 20 is formed with a rod groove 26 for receiving the piston rod 6.

An interior of the head 11 is formed with a motor air guide hole 10 and has an air guide channel 18 for communicating with the air inlet 29.

A guide seat 3 is installed in the head 11. A cross section of the guide seat 3 has an H shape. Each of two ends of the guide seat 3 has a respective protruding ring 31, 32 which is embedded into an inner wall of the head 11. Each protruding ring, 31, 32 is formed with an air stop washer 33 so that an inner walls of the guide seat 3 and the head 11 are formed with an interior air chamber 93 which is communicated to the motor air guide hole 10.

The guide seat 3 is formed with a stepped surface 30 with an expanding seat wall. At least one valve hole 34 can be formed on the guide seat 3 or the stepped surface 30 of the guide seat 3. The valve hole 34 is communicated to the interior air chamber 93 and the air guide hole 10 of the pneumatic motor 2.

The cylinder 4 is elastically movable and is movable installed in the guide seat 3. Near the top of the outer wall of the cylinder 4 is formed with a protruded disk-like plug 41. At least one ventilating holes 42 communicating to the cylinder chamber 40 is formed on the cylinder wall. An air stop washer 43 is disposed between the top of the plug 41 and the ventilating hole 42. The cylinder 4 has a touch to push surface 45. A washer ring 46 is arranged upon the surface 45. A stepped surface 47 is formed on an outer wall of the cylinder 4 for being enclosed by a lower spring 48 which resists against the cylinder 4. Thereby, the cylinder 4 is in a position to be ejected.

The ventilating hole 42 of the cylinder 4 causes that the cylinder chamber 40 is communicated to the valve hole 34, interior air chamber 93 and the motor air guide hole 10.

An upper side of the cylinder 4 is formed with a main air valve 8 and a main air valve gate 80. Two ends of the main air valve gate go have an upper valve opening 82 and a lower valve opening 83. When nailing, the upper valve opening 82 or the lower valve opening 83 is opened so as to communicate to the cylinder chamber 40. A lower end of the main air valve 8 is a top spring 81 which resists against the main air valve 8.

A top of the piston rod 6 can be reduced into the motor spindle 20. A lower end of the piston rod 6 has a piston valve 60 which is movably installed in the cylinder chamber 40. A lower end of the piston rod 6 is buckled with a screw nail locking rod 61 for screwedly locking a screw nail. The screw nail locking rod 61 protrudes out of the head 11 from the rod hole 44.

Figure 3:
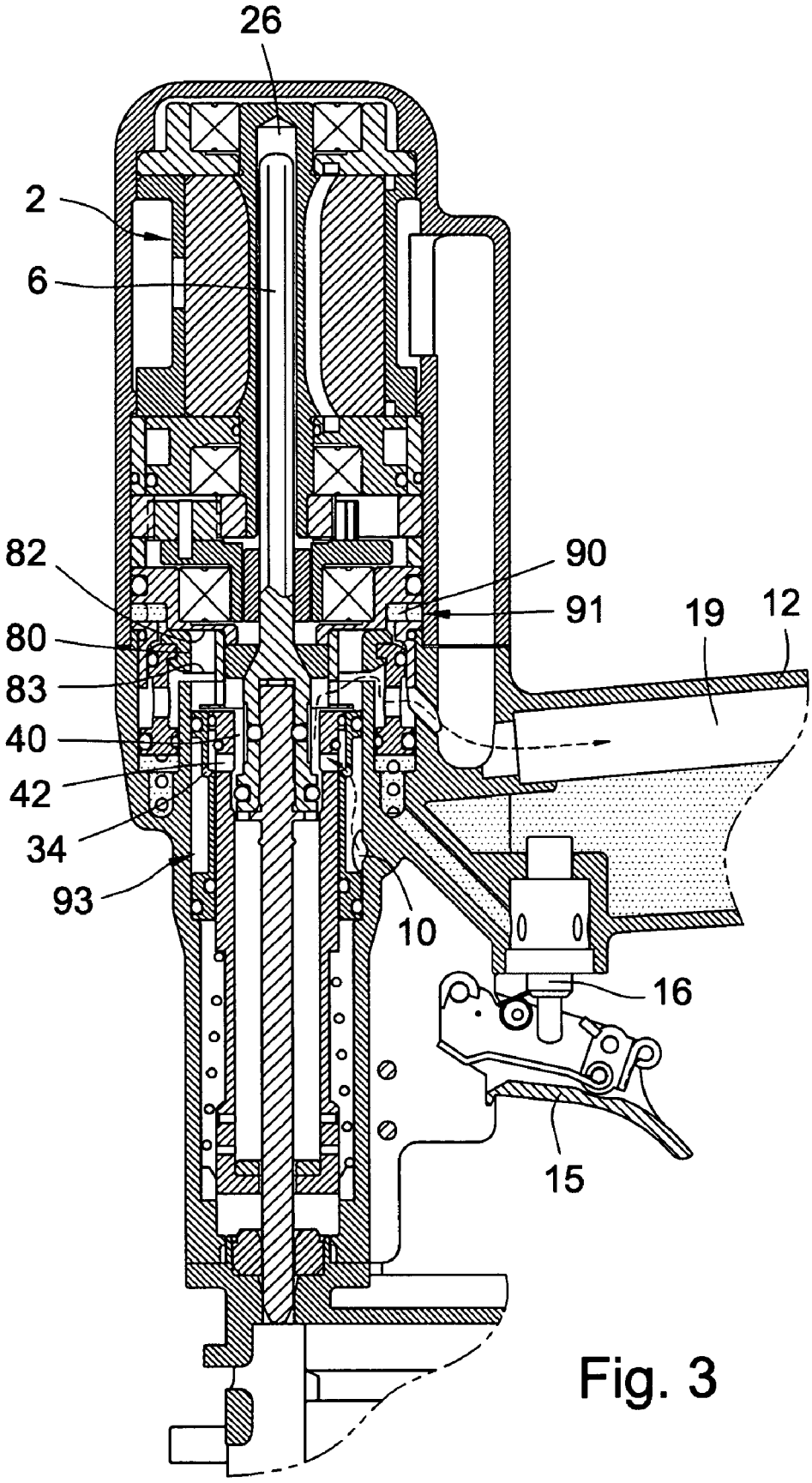
FIG. 3 is a cross sectional view showing the condition before pressing the trigger according to the present invention.

When the user does not press the trigger 15 (referring to FIG. 3), the upper valve opening 82 of the main air valve gate 80 is closed and the lower valve opening 83 is opened. High pressure air 90 in a top air chamber 91 can not flow into the cylinder chamber 40 so that the communicated ventilating hole 42, valve hole 34, interior air chamber 93 and the motor air guide hole 10 is communicated to an exhausting hole 19 in the handle 12 through the opening lower valve opening 83. Thereby, it is in a state for exhausting air out of the screwdriver. In this state, the piston rod 6 and the pneumatic motor 2 are not actuated and the piston rod 6 restores to a top position and is reduced in the rod groove 26.

Figure 4:
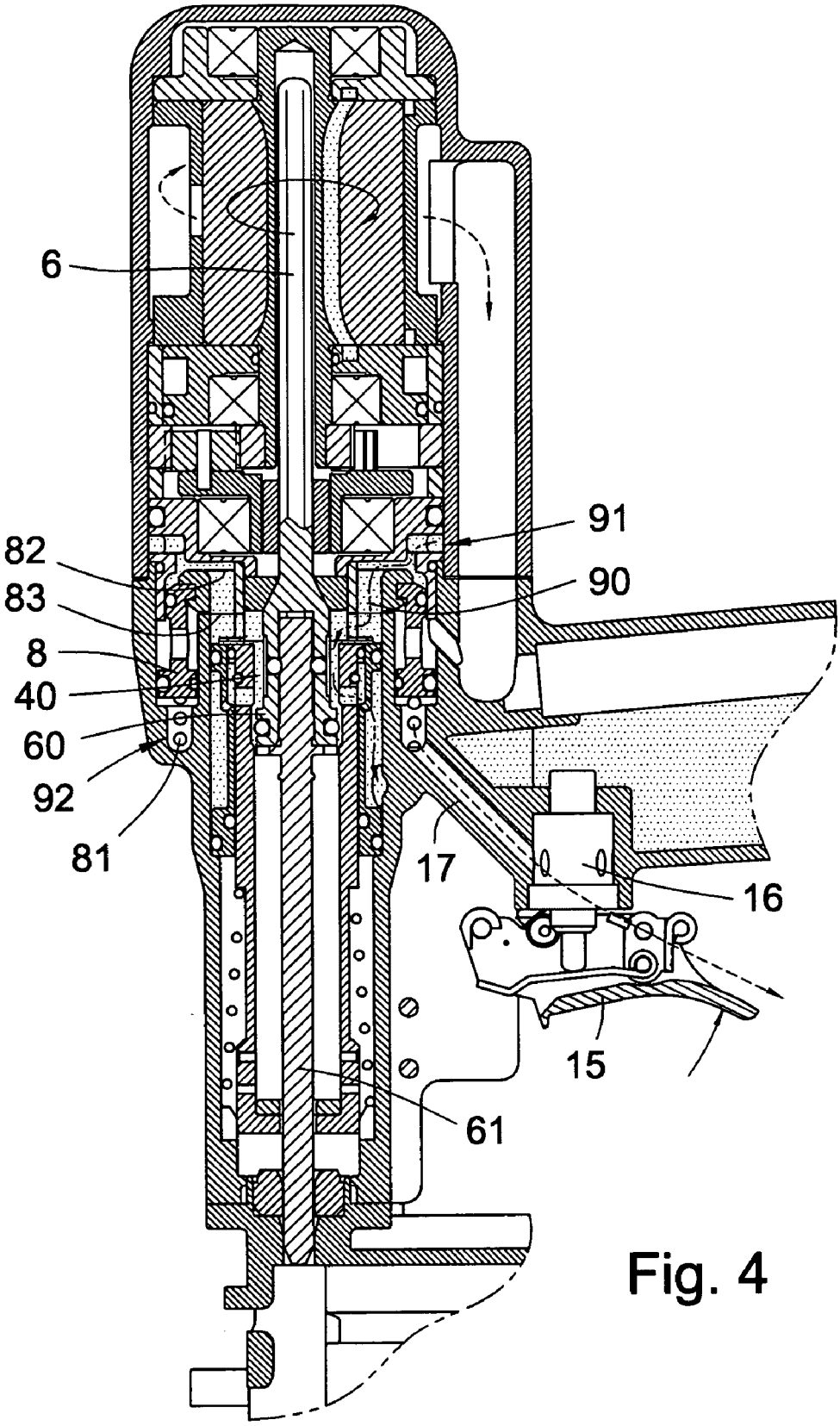
FIG. 4 is a cross sectional view showing the initial condition of pressing the trigger according to the present invention.
Figure 5:
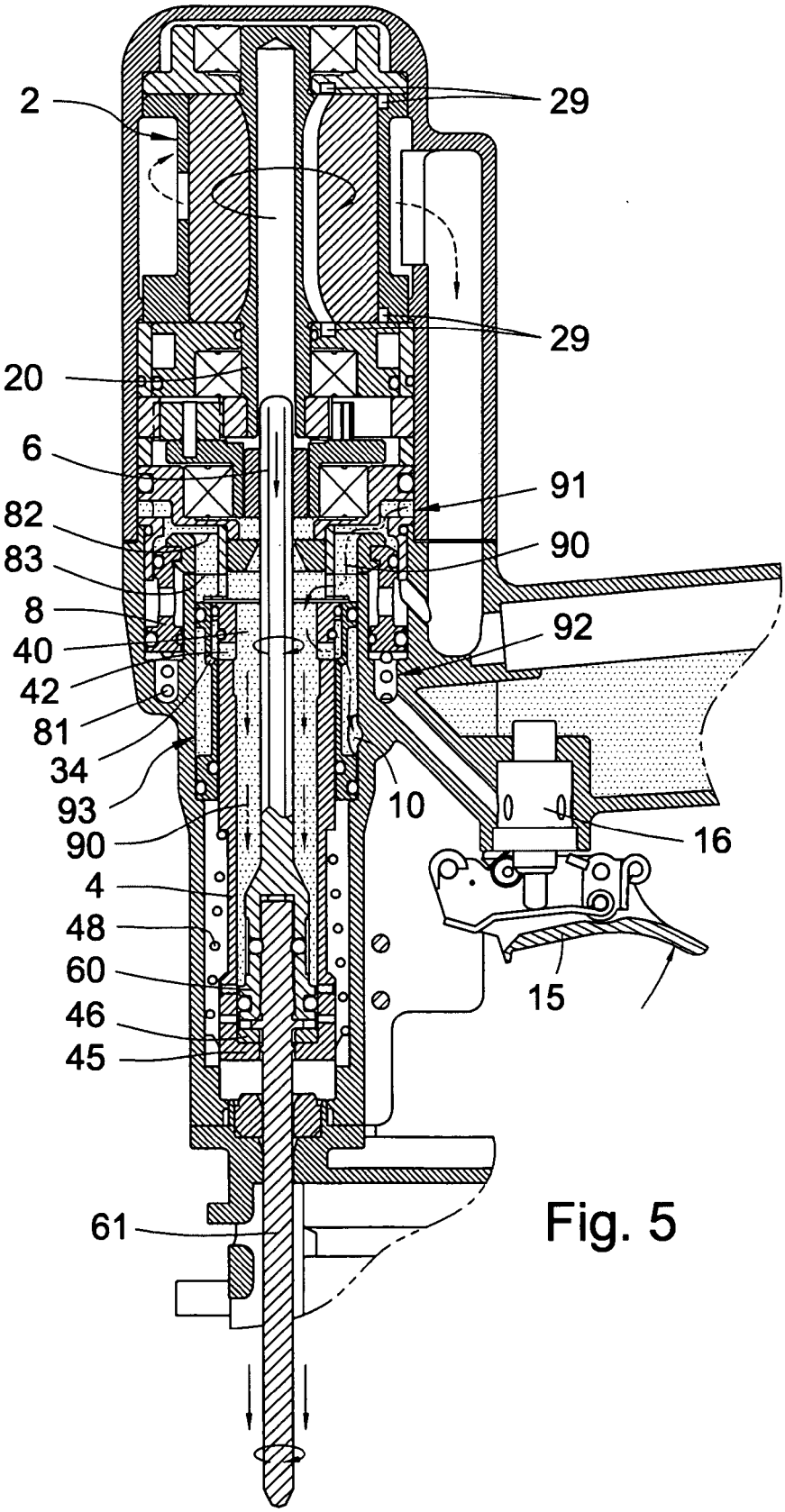
FIG. 5 is a cross sectional view showing that the piston rod descends after the trigger is pressed.

When the user presses the trigger 15 (referring to FIG. 4), the trigger valve 16 opens an exhausting path from a trigger air channel 17 to outside so that the high pressure air in a middle layer air chamber 92 is exhausted. At this moment, high pressure air is supplied to the top air chamber 91 of the main air valve 8 continuously. The supplied air pressure is larger than the pressure of the spring 81 in the middle layer air chamber 92. Thereby, the upper valve opening 82 is opened and the lower valve opening 83 is closed. The high pressure air 90 flows into the cylinder chamber 40 from the upper valve opening 82 to push the piston valve 60 so as to move linearly to push the screw nail locking rod 61 to descend rapidly (referring to FIG. 5). Meantime, the high pressure air 90 flows into the ventilating hole 42, valve-hole 34, interior air chamber 93 and motor air guide hole 10 from the cylinder chamber 40 and then to the air inlet 29 to rotate the motor spindle 20 of the motor 2. Thereby, the planet gear set 5 and the output disk 51 are driven to rotate so as to rotate the descending piston rod 6. Thus, the screw nail locking rod 61 is screwedly driving screw nail into a work piece.

Figure 6:
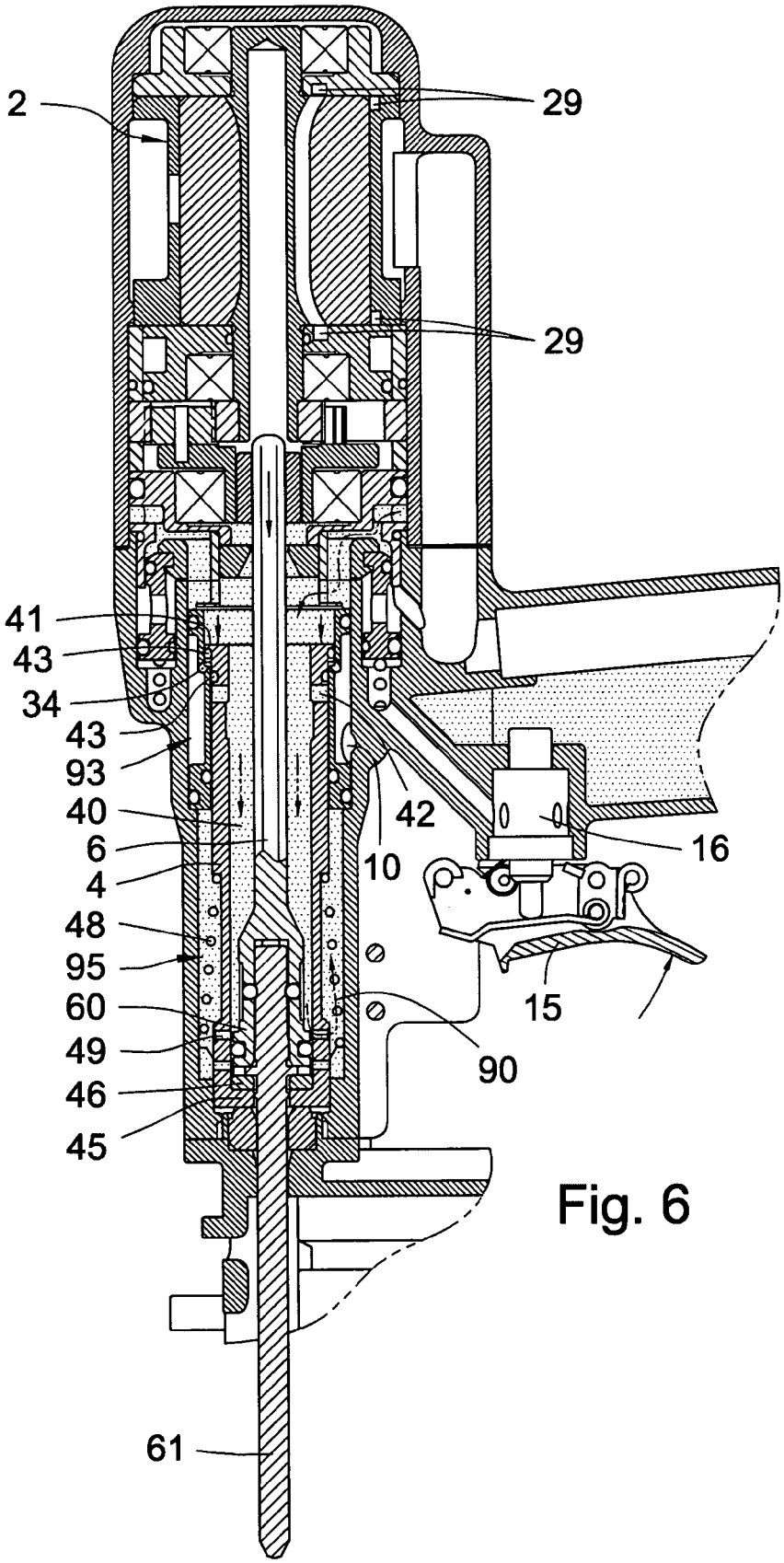
FIG. 6 is a cross sectional view showing that after the trigger is pressed, the piston rod moves forwards to an extreme position.

When the descending piston valve 60 touches and presses the touch and push surface 45 of the cylinder 4 and/or washer ring 46 (referring to FIG. 5), the cylinder 4 presses against the lower spring 48 to move downwards to a lower position (referring to FIG. 6). At this time, the screw nail is has been screwed into (locked into) the work piece. A plug 41 of the cylinder 4 displaces downwards to a position for closing the valve hole 34 so that the plug 41 and the air stop washer 43 near the lower end thereof completely seals the path from the valve hole 34 to the ventilating hole 42 and the cylinder chamber 40. As a result, the air path from the valve hole 34 to the inner layer air channel 93, motor air guide hole 10, and the air inlet 29 is isolated. Thus, the motor 2 stop and the high pressure air 90 in the cylinder chamber 40 at the top of the piston valve 60 is guided to a returning air chamber 95 by the guiding of the guide hole 49 at a lower end of the cylinder wall.

Figure 7:
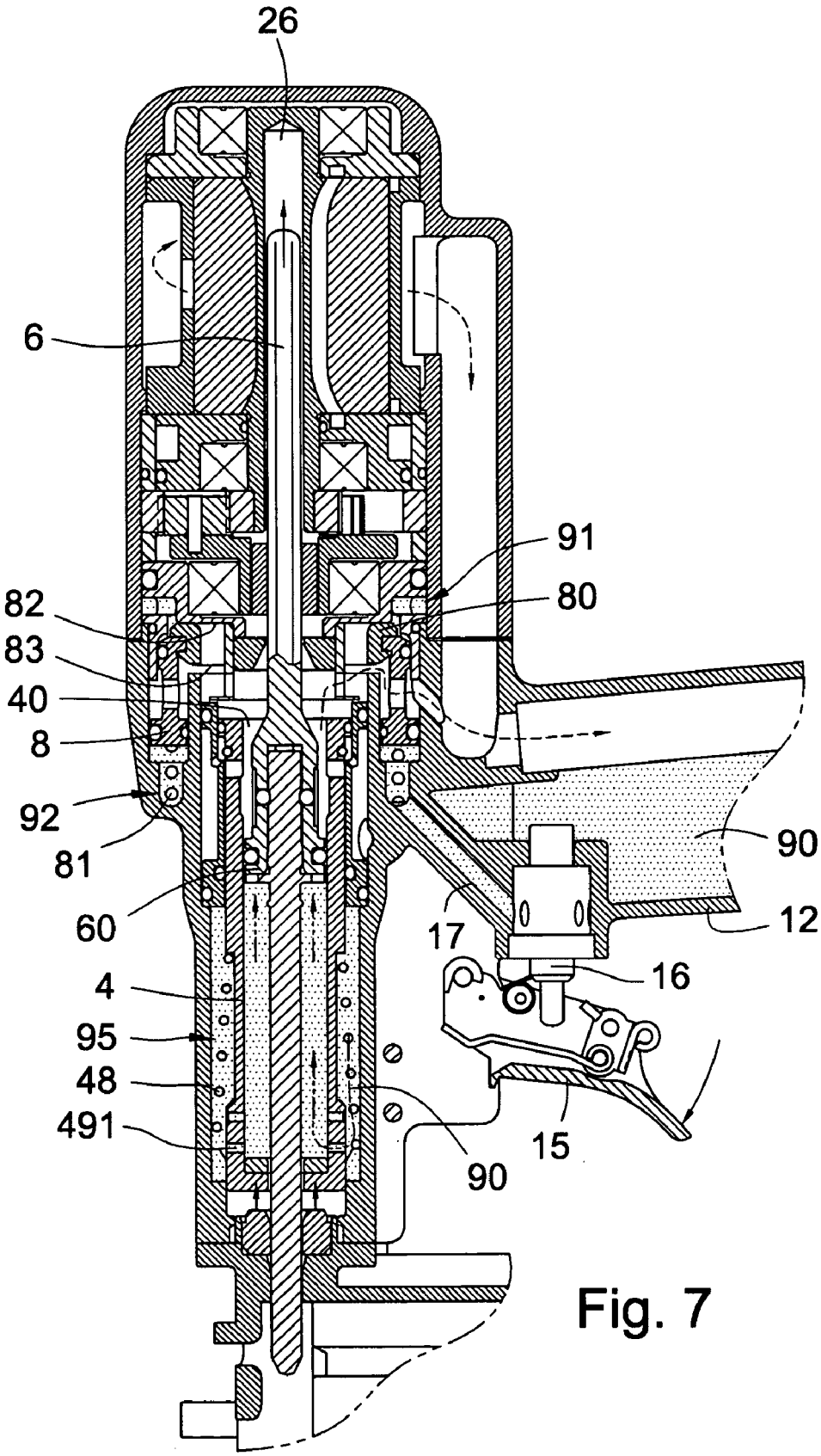
FIG. 7 is a cross sectional view showing a condition that the trigger is released and the piston rod returns.

Then, when the user releases the trigger 15 and thus releases the trigger valve 16 (referring to FIG. 7), the trigger valve 16 will close the air exhausting path from the trigger air channel 17 to outside and the high pressure air in the handle 12 passes through the trigger air channel 17 to enter into the middle layer air chamber 92 for accumulating air to have a great air pressure. Then by the restoring force of the top spring 81, the main air valve gate 80 of the main air valve 8 moves upwards to restore to the original position so as to seal the upper valve opening 82 and thus air supply of the high pressure air 90 is stopped. Meanwhile, the lower valve opening 83 is opened for releasing high pressure air in the cylinder chamber 40 at the top of the piston valve 60. The original accumulating high pressure air 90 in the returning air chamber 95 will guide into the cylinder 4 at the bottom of the piston valve 60 from the guide hole 491. With the air pressure and the restoring force of the lower spring 48, the piston rod 6 will move upwards and then reduce into the rod groove 26 (referring to FIG. 3).

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A pneumatic motor-controlled valve of a screwdriver installed between an air guide hole of a pneumatic motor and a main air valve gate in the screwdriver; the pneumatic motor-controlled valve having at least one valve hole on a guide seat and a cylinder; the main air valve gate being installed above the cylinder and having an upper valve opening and a lower valve opening; a piston rod being movable installed in the cylinder; the movement of the piston rod being actuated by air pressure and rotation of the piston rod being actuated by the pneumatic motor; wherein the valve hole is formed on the guide seat and is communicated to an air guide hole of the motor;

a plug is formed on an outer wall of the cylinder; and the cylinder is movably mounted within the guide seat;

a lower spring resists against the cylinder; a touch and push surface is formed on the cylinder so that the piston valve on the piston rod is capable of pushing the cylinder; at least one ventilating hole is formed on a wall of the cylinder for communicating the valve hole to one of the upper valve opening and the lower valve opening of the main air valve gate; and the plug drives the cylinder to actuate with the descending and rising of the piston valve so as to open or close the valve hole of the guide seat, thereby, the rotation of the motor is controlled.

2. The pneumatic motor-controlled valve of a screwdriver as claimed in claim 1, wherein the valve hole is formed on a stepped surface of an expanding wall of the guide seat.

3. The pneumatic motor-controlled valve of a screwdriver as claimed in claim 1, wherein each of two ends of the guide seat has a respective protruding ring which is embedded into an inner wall of the head; each protruding ring is formed with an air stop washer so that an inner walls of the guide seat and the head are formed with an interior air chamber which is communicated to the motor air guide hole.

* * * * *